US009909425B2

(12) United States Patent
Stone

(10) Patent No.: US 9,909,425 B2
(45) Date of Patent: Mar. 6, 2018

(54) BLADE FOR A GAS TURBINE ENGINE

(75) Inventor: Paul Stone, Guelph (CA)

(73) Assignee: PRATT & WHITNEY CANADA CORPORATION (CA)

( * ) Notice: Subject to any disclaimer, the term of this patent is extended or adjusted under 35 U.S.C. 154(b) by 354 days.

(21) Appl. No.: 13/285,332

(22) Filed: Oct. 31, 2011

(65) Prior Publication Data

US 2013/0108456 A1 May 2, 2013

(51) Int. Cl.
*F01D 5/14* (2006.01)
*F04D 29/32* (2006.01)

(52) U.S. Cl.
CPC ..... *F01D 5/141* (2013.01); *F01D 5/143* (2013.01); *F04D 29/324* (2013.01); *F05D 2220/36* (2013.01)

(58) Field of Classification Search
CPC .. F01D 5/141; F01D 5/143; F03B 7/00; F03B 3/12; B64C 27/46
USPC ..... 416/228, 235, 238, 223 R, 229 A, 234, 416/243, 242
See application file for complete search history.

(56) References Cited

U.S. PATENT DOCUMENTS

| | | | | |
|---|---|---|---|---|
| 5,397,215 | A | 3/1995 | Spear | |
| 5,725,355 | A | 3/1998 | Crall | |
| 6,019,580 | A | 2/2000 | Barr et al. | |
| 6,071,077 | A * | 6/2000 | Rowlands | 416/223 A |
| 6,195,983 | B1 | 3/2001 | Wadia et al. | |
| 6,471,474 | B1 | 10/2002 | Mielke et al. | |
| 6,733,240 | B2 * | 5/2004 | Gliebe | 416/228 |
| 6,951,447 | B2 | 10/2005 | Cherolis et al. | |
| 6,951,448 | B2 * | 10/2005 | Duesler | F01D 5/326 416/220 R |
| 6,969,232 | B2 | 11/2005 | Zess et al. | |
| 6,991,428 | B2 | 1/2006 | Crane | |
| 7,125,222 | B2 | 10/2006 | Cormier et al. | |
| 7,217,094 | B2 | 5/2007 | Cunha et al. | |
| 7,220,103 | B2 | 5/2007 | Cunha et al. | |
| 7,371,046 | B2 | 5/2008 | Lee et al. | |
| 7,465,155 | B2 | 12/2008 | Nguyen | |
| 7,625,181 | B2 | 12/2009 | Matsuda et al. | |
| 7,794,202 | B2 * | 9/2010 | Borthwick et al. | 415/192 |
| 7,806,652 | B2 * | 10/2010 | Major et al. | 415/160 |
| 2004/0253110 | A1 * | 12/2004 | Crane | 416/193 A |

(Continued)

FOREIGN PATENT DOCUMENTS

| | | | |
|---|---|---|---|
| EP | 2014386 | A1 | 1/2009 |
| EP | 2080909 | A1 | 7/2009 |
| EP | 2290244 | A2 | 3/2011 |

*Primary Examiner* — Igor Kershteyn
*Assistant Examiner* — Brian P Wolcott
(74) *Attorney, Agent, or Firm* — Norton Rose Fulbright Canada LLP

(57) ABSTRACT

A gas turbine airfoil blade comprises an airfoil having a leading edge and a trailing edge defining fore and aft points of an airfoil chord relative to a flowpath direction. The airfoil extends generally radially from a root to a tip, the root of the airfoil intersecting a platform of the blade. A body of the airfoil is composed of a plurality of airfoil sections stacked along a stacking line extending radially from the platform. A root airfoil section being the one of said airfoil sections intersecting the platform, the trailing edge at the root airfoil section extending to intersect the platform chordwise aft of the trailing edge of the airfoil section immediately radially outwardly adjacent to the root airfoil section.

9 Claims, 5 Drawing Sheets

(56) References Cited

U.S. PATENT DOCUMENTS

| | | | | |
|---|---|---|---|---|
| 2007/0269316 | A1* | 11/2007 | Williams et al. | 416/223 R |
| 2008/0063520 | A1* | 3/2008 | Baumann et al. | 415/209.3 |
| 2009/0123276 | A1* | 5/2009 | Greim et al. | 415/193 |
| 2010/0158696 | A1* | 6/2010 | Pandey et al. | 416/243 |
| 2010/0329888 | A1* | 12/2010 | Nadvit et al. | 416/97 R |
| 2011/0033292 | A1* | 2/2011 | Huth | F01D 21/045 416/1 |
| 2011/0064580 | A1 | 3/2011 | Barnes | |
| 2011/0110784 | A1 | 5/2011 | DeMania et al. | |

* cited by examiner

BLADE FOR A GAS TURBINE ENGINE

TECHNICAL FIELD

The application relates generally to gas turbine engines and, more particularly, to blades used in gas turbine engines.

BACKGROUND OF THE ART

A typical turbofan airfoil is relatively thin near the trailing edge root. The intersection of the thin trailing edge and the thicker root fillet radius tends to cause a high stress concentration in the region, especially in larger blades such as fan blades. This stress concentration tends to reduce fan blade life, and hence room for improvement exists.

SUMMARY

In one aspect, there is provided a gas turbine airfoil blade comprising an airfoil having a leading edge and a trailing edge defining fore and aft points of an airfoil chord relative to a flowpath direction, the airfoil extending generally radially from a root to a tip, the root of the airfoil intersecting a platform of the blade, a body of the airfoil composed of a plurality of airfoil sections stacked along a stacking line extending radially from the platform, a root airfoil section being the one of said airfoil sections intersecting the platform, the trailing edge at the root airfoil section extending to intersect the platform chordwise aft of the trailing edge of the airfoil section immediately radially outwardly adjacent to the root airfoil section.

In a second aspect, there is provided a gas turbine fan comprising a plurality of airfoils circumferentially distributed and projecting radially from a platform, each said airfoil having a leading edge and a trailing edge defining fore and aft points of an airfoil chord relative to a flowpath direction, each said airfoil extending generally radially from a root to a tip, the root of each said airfoil intersecting the platform of the fan, a body of each said airfoil composed of a plurality of airfoil sections stacked along a stacking line extending radially from the platform, a root airfoil section being the one of said airfoil sections intersecting the platform, the trailing edge at the root airfoil section extending to intersect the platform chordwise aft of the trailing edge of the airfoil section immediately radially outwardly adjacent to the root airfoil section.

Further details of these and other aspects of the present invention will be apparent from the detailed description and figures included below.

DESCRIPTION OF THE DRAWINGS

Reference is now made to the accompanying figures, in which.

DETAILED DESCRIPTION

Figure 1:
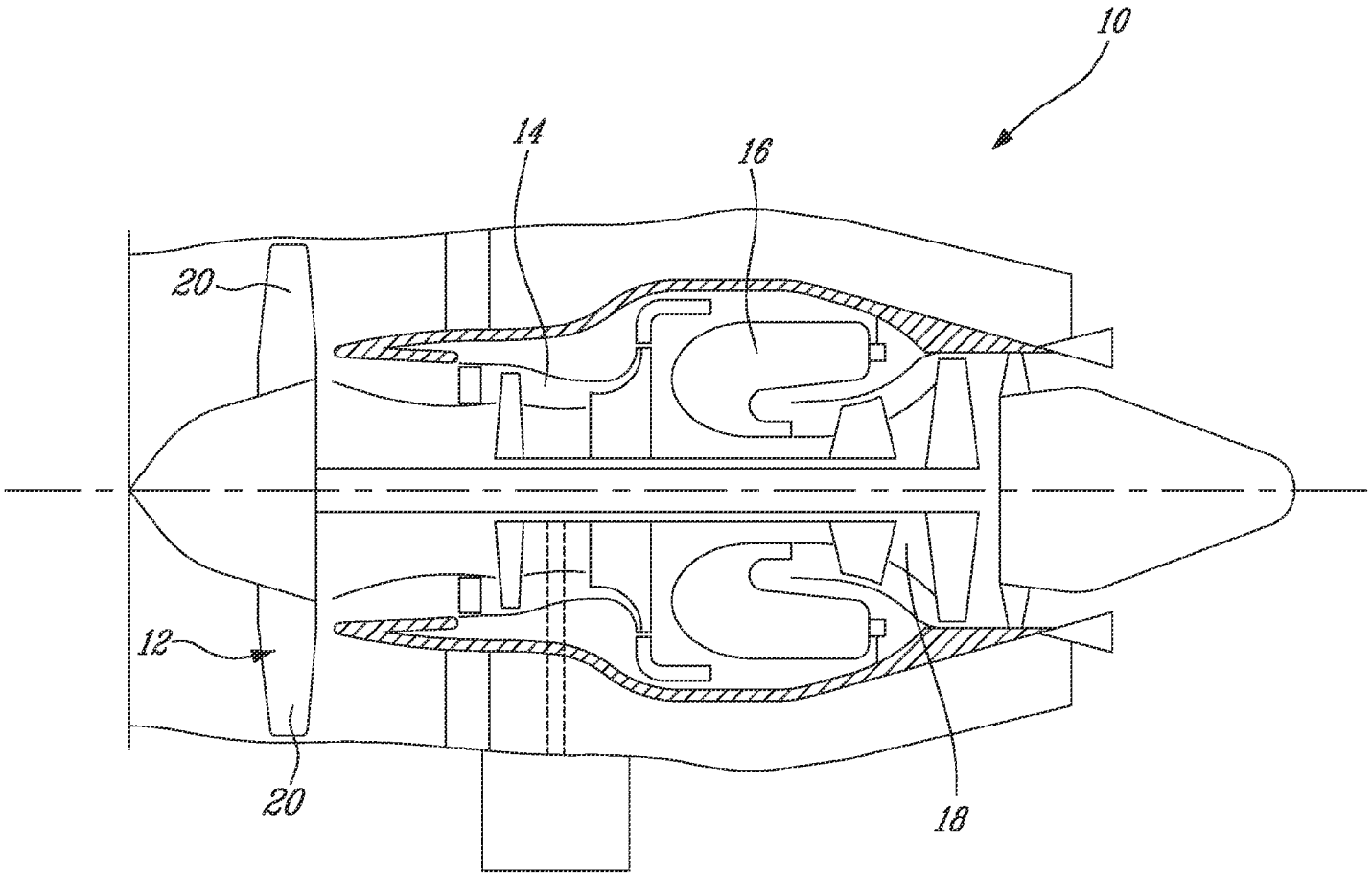
FIG. 1 is a schematic cross-sectional view of a turbofan gas turbine engine with a fan blade in accordance with the present disclosure.

FIG. 1 illustrates a turbofan gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. The fan 12 has a plurality of fan blades 20 circumferentially distributed about a rotor.

Figure 3:
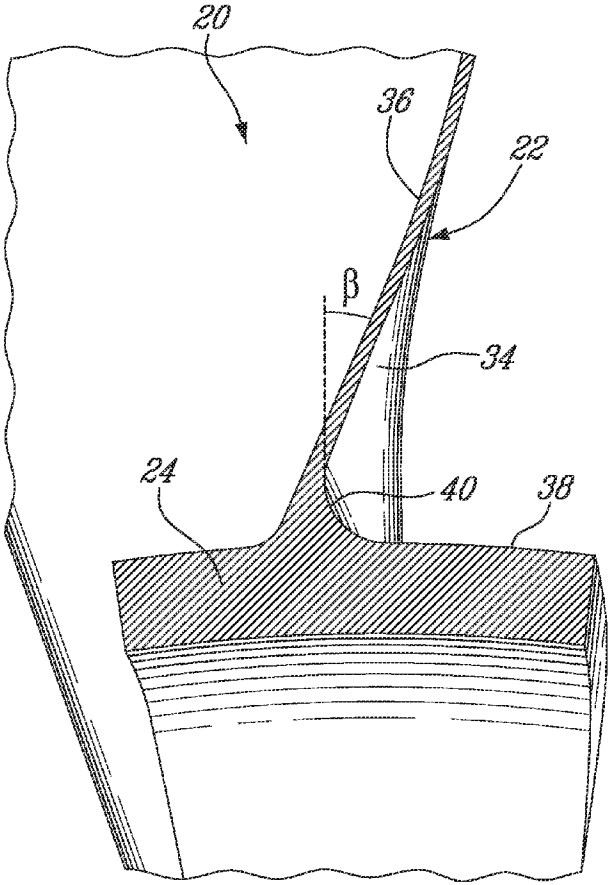
FIG. 3 is a radial sectional view of he fan blade according to one aspect of present disclosure.
Figure 2:
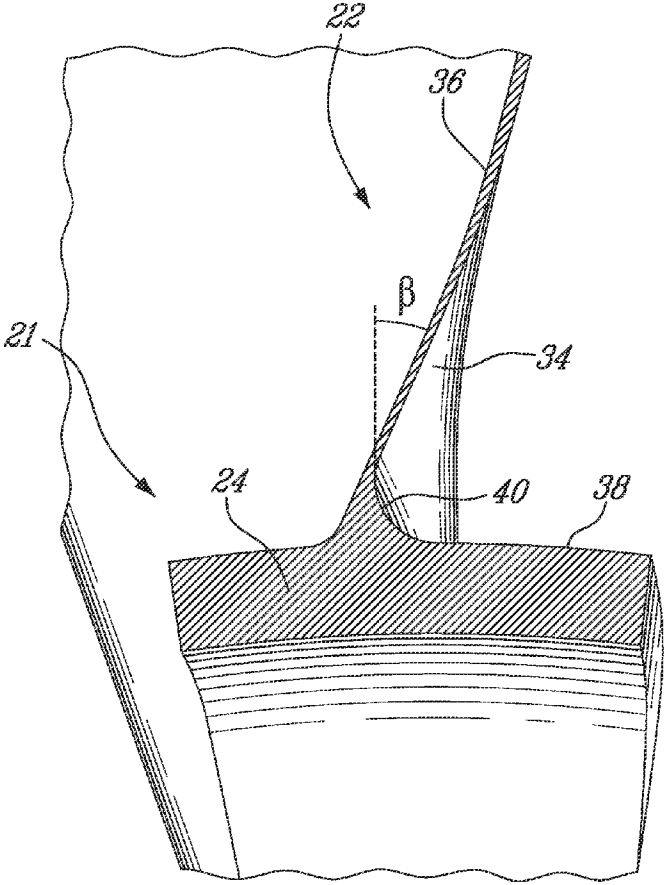
FIG. 2 (PRIOR ART)
FIG. 2 is a radial sectional view of a fan blade with a more conventional shape.
Figure 4:
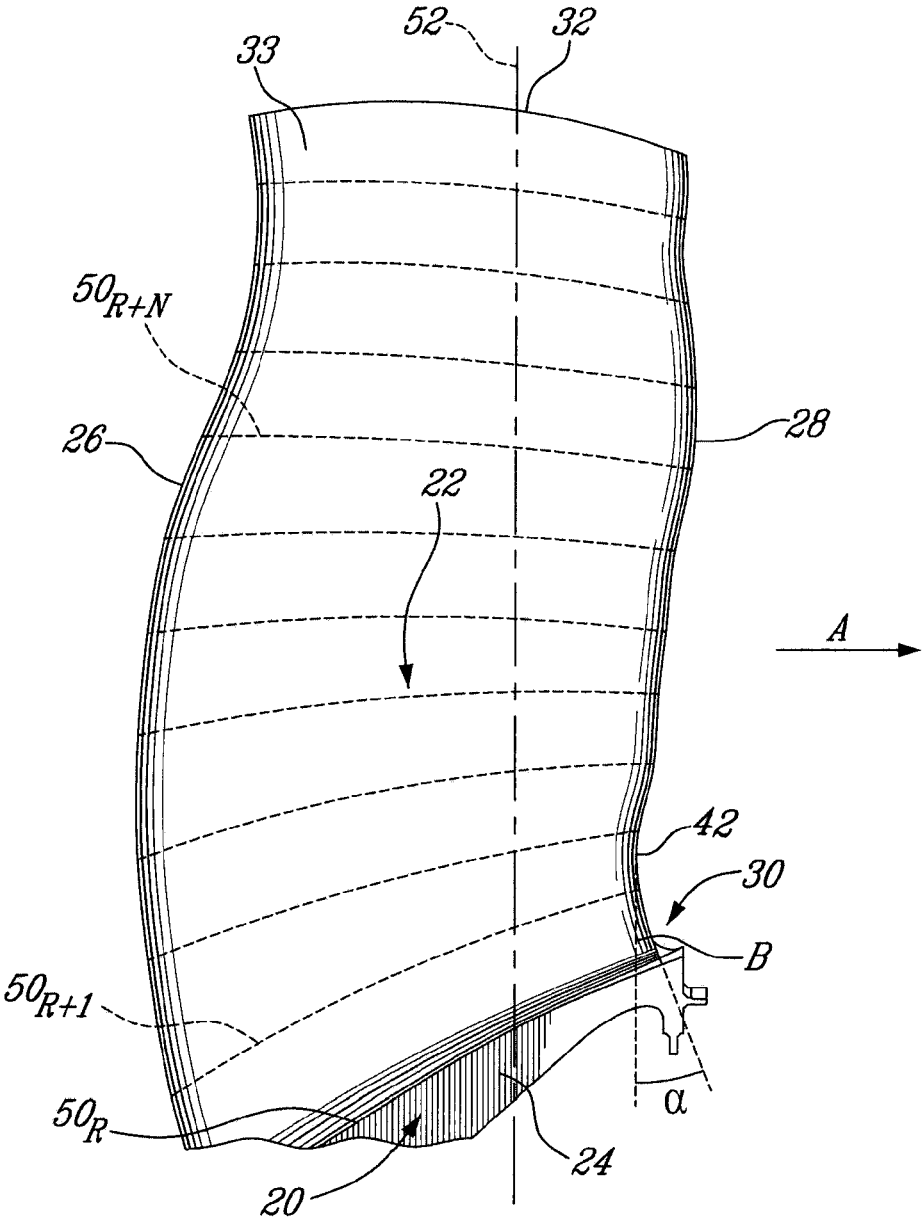
FIG. 4 is a side view of an airfoil of the fan blade of FIG. 3.

Referring concurrently to FIGS. 3 and 4, a fan blade 20 in accordance with the present disclosure is shown in greater detail. It is pointed out that FIG. 2 depicts a fan blade 21 of a more typical design, for comparison purposes. The fan blade 21 of FIG. 2 has similar parts to fan blade 20, but differs in geometry, whereby like elements of the fan blades of FIG. 2 and FIGS. 3-4 are indicated by like reference numerals. The fan blade 20 of FIGS. 3 and 4 comprises an airfoil 22 projecting generally radially from a hub platform 24. The platform 24 may instead be a portion of an integrated bladed rotor hub rather than an individual fan blade platform as depicted here.

Referring to FIG. 4, the airfoil 22 has a leading edge 26 and a trailing edge 28. The airfoil 22 has a trailing edge region 30 in which the trailing edge 28 extends generally all in the chordwise direction, as described hereinafter. The airfoil 22 extends from the intersection between the airfoil 22 and the platform 24 at the airfoil root (not indicated) to a tip 32 which comprises the radially outward end of the airfoil 22. The airfoil 22 has a span from the hub platform 24 to the tip 32, while a chord (not indicated) is an imaginary straight line extending from the trailing edge 28 to the leading edge 26 of the cross-section of the airfoil 22. In this example, FIG. 4, depicts a blade which has a leading edge forward sweep 33 at the tip 32. However, any suitable fan blade design may be employed with the present concept.

Referring to FIG. 3, a sectional view of the fan blade 20 is provided, viewed forwardly along the line B in FIG. 4. The airfoil 22 has a convex suction side 34 and an opposite concave pressure side 36. The platform 24 defines a radially inner flowpath surface 38. A fillet radius 40 is provided at the junction of the convex suction side 34 and the radially inner flowpath surface 38.

The airfoil 22 is conceptually divided into a plurality of airfoil sections 50 extending generally parallel to the anticipated aerodynamic streamlines. The airfoil sections 50 may not appear parallel from FIG. 4 due to the perspective nature of the image, but are generally section lines between sections 50 may be generally parallel to one another. Each section has a height which is typically less than 20%, and perhaps 10% or less, than the entire blade height. Successive sections are stacked along a generally radially-extending stacking line 52, and staggered according to a stagger angle (not indicated). It will be understood that each section of the airfoil 22 has blade angles at the leading edge 26 and the trailing edge 28 which determine the airfoil camber and stagger angles. In this description, the airfoil section intersecting the platform 24 and extending upward therefrom is indicated by the reference numeral $\mathbf{50}_R$, while the airfoil section 50 immediately radially outward of the root airfoil section is indicated as $\mathbf{50}_{R+1}$. For clarity, the root airfoil section $\mathbf{50}_R$ extends from the platform 24 to the airfoil section $\mathbf{50}_{R+1}$, the latter having its bottom delimited by the section line labelled $\mathbf{50}_{R+1}$.

Referring to FIG. 4, when compared to the trailing edge of prior art fan blades (indicated by line B), the trailing edge 28 of the fan blade 20, at the airfoil root section $\mathbf{50}_R$, has a trailing edge portion in which the trailing edge extends generally aft in the chordwise direction (i.e., the direction being illustrated by A in FIG. 4) relative to the airfoil section $\mathbf{50}_{R+1}$ immediately radially above the root airfoil section $\mathbf{50}_R$, and relative to the prior art trailing edge indicated by line B. The profile shape of the trailing edge in region 30 may be straight, slightly curved or have any other suitable shape. The angle $\alpha$ may be 20 degrees from a line radially perpendicular to the centerline of the gas turbine engine 10 (FIG. 1), and may have any suitable range, such as between 15 degrees to 25 degrees. According, as the line is radially perpendicular to the centerline of the gas turbine engine 10, the trailing edge 28 at the root airfoil section intersects the platform at an angle ranging between 65 degrees and 70 degrees (i.e., $90°-\alpha$).

The trailing edge 28 may define a region of relative concavity in trailing edge region 52 which, depending on the shape of the leading edge, may result in reduced chord length in the airfoil section(s) above the root airfoil section $\mathbf{50}_R$, relative to a corresponding chord length of the root section. The trailing edge 28 extends generally aft relative to the trailing edge of the airfoil sections defining the region 42. For instance, as depicted in FIG. 4, according to one embodiment, some of the airfoil sections approaching closer to the blade tip 32 may have a trailing edge portion which extends aft in a chordwise direction relative to the trailing edge of airfoil section $\mathbf{50}_{R+1}$ in the region 42. For example, at the section indicated $\mathbf{50}_{R+n}$ the trailing edge 28 extends aft in a chordwise direction relative to the trailing edge of the airfoil section $\mathbf{50}_{R+1}$ in the region 42.

Referring again to FIG. 3, the associated geometric effects of providing trailing edge extension region 30 may result in the surface of the airfoil suction side 34 being closer to a radial line adjacent to the fillet radius 40, as shown by angle $\beta$ (measured between the suction side 34 and a radial line extending from the platform fillet radius), relative to a more typical design as shown in FIG. 2 (i.e., angle $\beta$ in FIG. 3 is less than angle $\beta$ of FIG. 2). As well, providing trailing edge extension region 30 may tend to increase the thickness of the blade at the location of line B (see FIG. 4). Since the trailing edge tends to be exposed to relatively high root stresses, the present approach may assist in reducing overall stresses at the trailing edge root.

Figure 5:
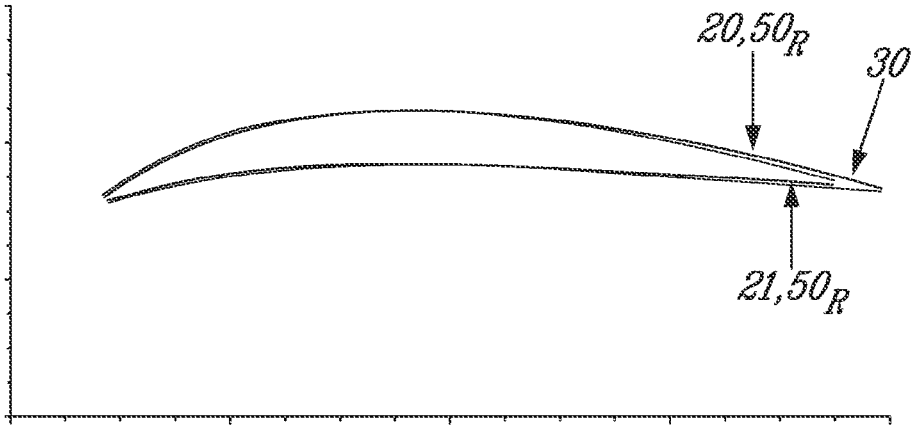
FIG. 5 is a graph schematically showing a top view superposition of respective root airfoil sections of the fan blades of FIGS. 2 and 3.

Referring to FIG. 5, there is illustrated a top radial view superposition of respective root airfoil sections $\mathbf{50}_R$ of the fan blades 21 and 20 of FIGS. 2 and 3, respectively. The region 30 of the airfoil 22 of the fan blade 20 is clearly shown as extending beyond the trailing edge of the airfoil 22 of fan blade 21.

Figure 6:
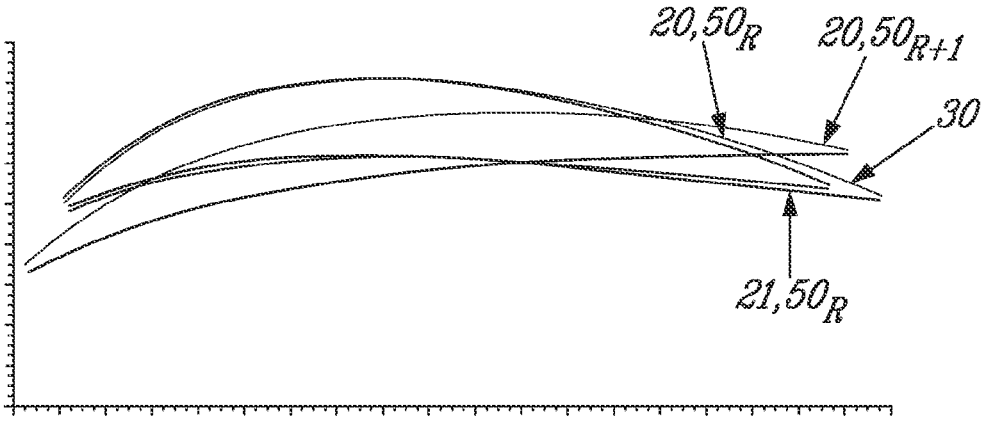
FIG. 6 is a graph schematically showing a top view similar to FIG. 5, also showing an airfoil section adjacent the root airfoil section for the fan blade of FIG. 3.

Referring to FIG. 6, the graph of FIG. 5 is shown with the addition of the airfoil section $\mathbf{50}_{R+1}$ immediately adjacent the root airfoil section $\mathbf{50}_R$ for the airfoil 22 of the fan blade 20 of FIG. 3. The region 30 of root airfoil section $\mathbf{50}_R$ of the airfoil 22 is clearly shown as extending beyond the trailing edge of the airfoil section $\mathbf{50}_{R+1}$.

Figure 7:
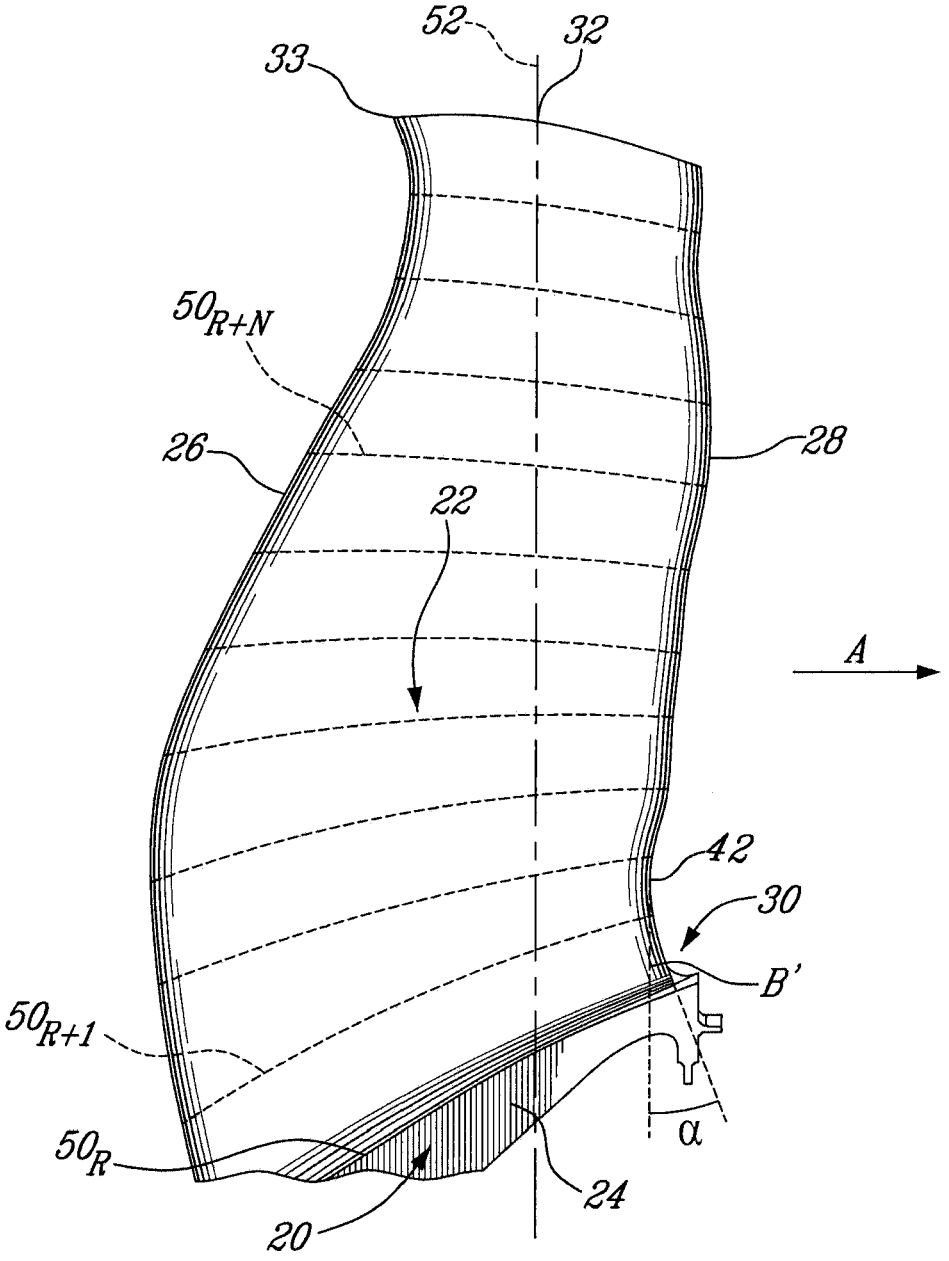
FIG. 7 is a side view of an airfoil of a fan blade according to another aspect of the present disclosure.

According to an embodiment depicted in FIG. 7, the trailing edge 28 in region 30' of root airfoil section $\mathbf{50}_R$ extends aft of the trailing edge of sections $\mathbf{50}_{R+1}$ and so on, immediately above (i.e., radially outwardly of the root airfoil section $\mathbf{50}_R$. Depending on the leading edge shape, this may result in the chord length of the sections just above the root area being reduced from the trailing edge 26 relative to the nominal trailing edge line B'. The trailing edge of the root airfoil section $\mathbf{50}_R$ in the region 30' extends aft of the trailing edge of the airfoil sections immediately above the root section. This may be achieved by relatively reducing the chord length of the sections just above the root airfoil section $\mathbf{50}_R$, instead of increasing the chord length in the root section region 30' as above.

The extension region 30 may beneficially result in an increase in the natural frequency of the lower modes (e.g., $1^{st}$ and $2^{nd}$ modes). The more radial shape to the blade trailing edge 28 near the root may result a reduction in aerodynamic blockage caused by the fillet radius 40 at the trailing edge 28. The increased chord length and/or the reduced thickness/chord length ratio may be beneficial to the aerodynamics of the blade fan 20.

The above description is meant to be exemplary only, and one skilled in the art will recognize that changes may be made to the embodiments described without departing from the scope of the invention disclosed. For example, the blade may be any suitable blade and need not be a turbofan fan blade. The leading edge and overall fan blade design need not be as depicted but may be any suitable. As mentioned, the blade may appear on an integrally bladed rotor, or may be provided as part of a bladed rotor assembly. Still other modifications which fall within the scope of the present invention will be apparent to those skilled in the art, in light of a review of this disclosure, and such modifications are intended to fall within the appended claims.

What is claimed is:

1. A turbofan fan blade comprising an airfoil having a leading edge and a trailing edge defining fore and aft points of an airfoil chord relative to a flowpath direction, the airfoil extending generally radially from a root to a tip, said leading edge and said trailing edge extending from root to tip, the root of the airfoil intersecting a platform of the blade at a fillet radius, a body of the airfoil composed of a plurality of airfoil sections stacked along a stacking line extending radially from the platform above the fillet radius, a root airfoil section being the one of said plurality of airfoil sections intersecting the fillet radius, said trailing edge shaped at the root airfoil section to intersect the platform chordwise aft of the trailing edge of an airfoil section immediately radially outwardly adjacent to the root airfoil section, a chord length of said airfoil section immediately radially outwardly adjacent to the root airfoil section being less than a chord length of the root airfoil section and less than a chord length of another immediate radially outwardly adjacent airfoil section, a trailing edge concavity formed in the trailing edge adjacent to the fillet radius relative to a remainder of the trailing edge, the concavity being defined at the root airfoil section and said airfoil section immediately radially outwardly adjacent to the root airfoil section, the concavity being nonrepetitive.

2. The turbofan fan blade according to claim 1, wherein the leading edge of the blade has a forward sweep at the tip.

3. The turbofan fan blade according to claim 1, wherein a projection of the trailing edge at the root airfoil section intersects the platform at an angle ranging between 65 degrees and 75 degrees relative to an axis of rotation of the blade.

4. The turbofan fan blade according to claim 3, wherein a projection of the trailing edge at the root airfoil section intersects the platform at an angle of approximately 20 degrees.

5. A turbofan fan comprising a plurality of fan blades, each of the plurality of fan blades having an airfoil circumferentially distributed and projecting radially from a platform, each said airfoil having a leading edge and a trailing edge defining fore and aft points of an airfoil chord relative to a flowpath direction, each said airfoil extending generally radially from a root to a tip, said leading edges and a trailing edges extending from root to tip, the root of each said airfoil intersecting the platform of each fan blade at a fillet radius, a body of each said airfoil composed of a plurality of airfoil sections stacked along a stacking line extending radially from the platform above the fillet radius, a root airfoil section being the one of said plurality of airfoil sections intersecting the fillet radius, said trailing edge shaped at the root airfoil section to intersect the platform chordwise aft of the trailing edge of an airfoil section immediately radially outwardly adjacent to the root airfoil section, a chord length of said airfoil section immediately radially outwardly adjacent to the root airfoil section being less than a chord length of the root airfoil section and less than a chord length of another immediate radially outwardly adjacent airfoil section, a trailing edge concavity formed in the trailing edge adjacent to the fillet radius relative to a remainder of the trailing edge, the concavity being defined at the root airfoil section and said airfoil section immediately radially outwardly adjacent to the root airfoil section, the concavity being nonrepetitive.

6. The turbofan fan according to claim 5, wherein the leading edge of each said airfoil has a forward sweep at the tip.

7. The turbofan fan according to claim 5, wherein a projection of the trailing edge at the root airfoil section intersects the platform at an angle ranging between 65 degrees and 75 degrees relative to an axis of rotation of the turbofan fan.

8. The turbofan fan according to claim 7, wherein a projection of the trailing edge at the root airfoil section intersects the platform at an angle of approximately 20 degrees.

9. The turbofan fan according to claim 5, wherein the platform and the airfoils are integrally formed as an integrated bladed rotor.

* * * * *